US008342093B2

(12) United States Patent
Westphal et al.

(10) Patent No.: US 8,342,093 B2
(45) Date of Patent: Jan. 1, 2013

(54) FUZE FOR A PROJECTILE

(75) Inventors: Guenter Westphal, Hardt (DE); Markus Kopf, Zimmern-Stetten O.R. (DE)

(73) Assignee: Junghans Microtec GmbH, Dunningen-Seedorf (DE)

( * ) Notice: Subject to any disclaimer, the term of this patent is extended or adjusted under 35 U.S.C. 154(b) by 0 days.

(21) Appl. No.: 13/098,777

(22) Filed: May 2, 2011

(65) Prior Publication Data

US 2011/0203474 A1 Aug. 25, 2011

Related U.S. Application Data

(63) Continuation of application No. PCT/EP2009/007659, filed on Oct. 27, 2009.

(30) Foreign Application Priority Data

Oct. 30, 2008 (DE) ..... 10 2008 053 990

(51) Int. Cl.
*F42C 15/22* (2006.01)

(52) U.S. Cl. ..... 102/237; 102/253

(58) Field of Classification Search ..... 102/256, 102/231, 237, 249, 253, 254, 233
See application file for complete search history.

(56) References Cited

U.S. PATENT DOCUMENTS

| | | | | | |
|---|---|---|---|---|---|
| 4,128,061 | A | * | 12/1978 | Kaiser | 102/249 |
| 4,449,457 | A | * | 5/1984 | Halssig | 102/251 |
| 4,464,991 | A | | 8/1984 | Kaiser | |
| 4,683,823 | A | * | 8/1987 | Dinger et al. | 102/229 |
| 4,691,634 | A | | 9/1987 | Titus et al. | |
| 4,876,960 | A | * | 10/1989 | Schillinger et al. | 102/249 |
| 5,063,847 | A | * | 11/1991 | Halssig et al. | 102/271 |
| 2008/0173202 | A1 | | 7/2008 | Kienzler et al. | |

FOREIGN PATENT DOCUMENTS

| | | | |
|---|---|---|---|
| DE | 1 988 947 | U1 | 7/1968 |
| DE | 1988947 | A1 | 7/1968 |
| DE | 31 07 110 | A1 | 9/1982 |
| DE | 44 20 881 | A1 | 12/1995 |
| DE | 197 28 412 | A1 | 1/1999 |
| EP | 1 500 902 | A1 | 1/2005 |
| EP | 1 826 527 | A1 | 8/2007 |
| EP | 1826527 | A1 | 8/2007 |
| EP | 1 916 497 | A1 | 4/2008 |

OTHER PUBLICATIONS

International Search Report of PCT/EP2009/007659, Dated Jan. 21, 2010.

* cited by examiner

*Primary Examiner* — Benjamin P Lee

(74) *Attorney, Agent, or Firm* — Laurence A. Greenberg; Werner H. Stemer; Ralph E. Locher

(57) ABSTRACT

A fuze for a projectile having a firing chain has an interrupter for interruption of the firing chain. The interrupter is configured to snap from a safe position to an armed position when unlocked. A locking device is disposed to lock the interrupter in the safe position and to unlock the interrupter by way of an unlocking movement. The fuze is rendered compact and reliable in that the unlocking movement of the locking device is an axial movement.

14 Claims, 4 Drawing Sheets

FIG. 3
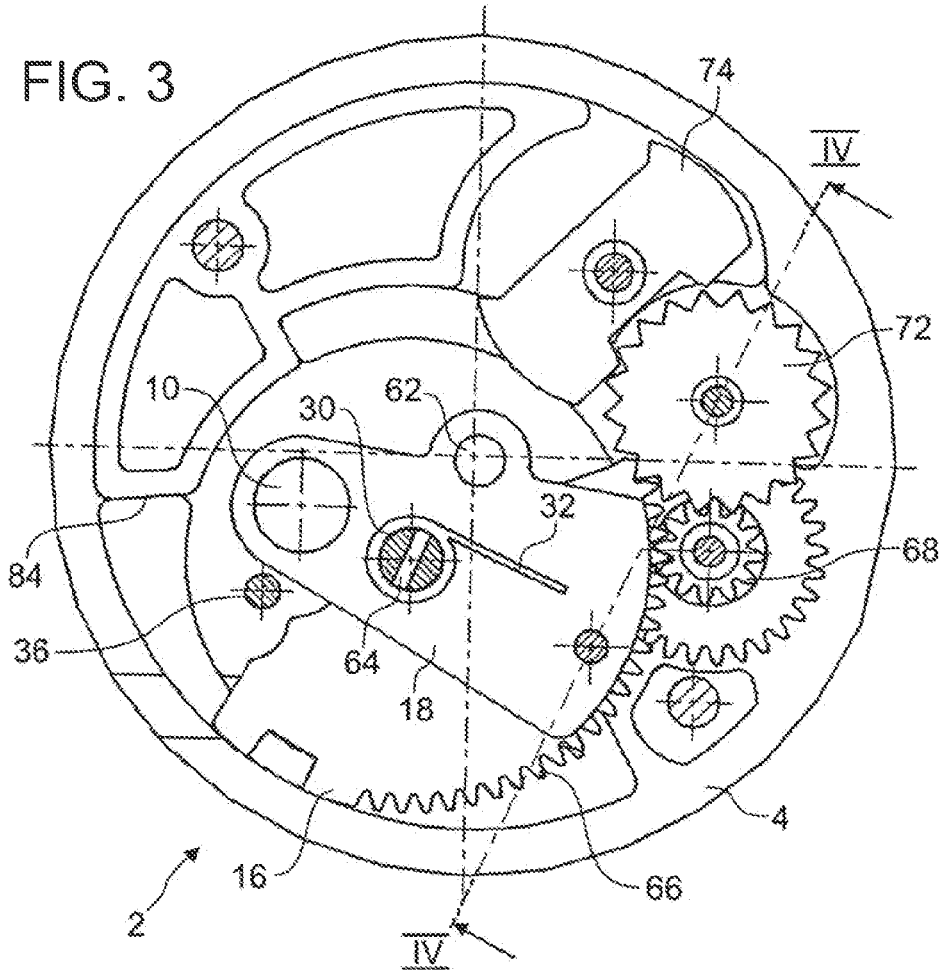
FIG. 4
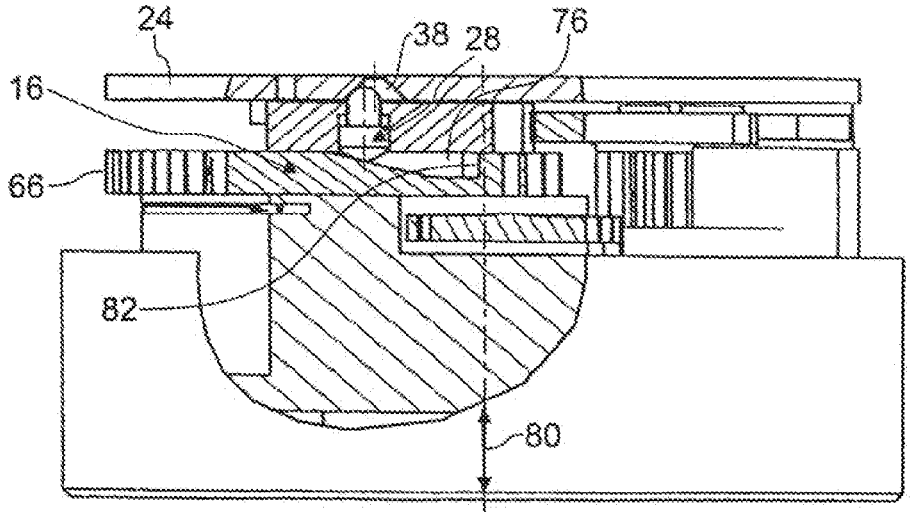
Fig. 4

FUZE FOR A PROJECTILE

CROSS-REFERENCE TO RELATED APPLICATION

This application is a continuation, under 35 U.S.C. §120, of copending international application No. PCT/EP2009/007659, filed Oct. 27, 2009, which designated the United States; this application also claims the priority, under 35 U.S.C. §119, of German patent application No. DE 10 2008 053 990.2, filed Oct. 30, 2008; the prior applications are herewith incorporated by reference in their entirety.

BACKGROUND OF THE INVENTION

Field of the Invention

The invention relates to a fuze for a projectile having a firing chain and an interrupter for interruption of the firing chain.

Projectiles such as artillery projectiles, mortar shells or direct projectiles normally have a fuze with a firing chain which, in its armed position, comprises two or more firing charges arranged one behind the other. The last of these firing charges, the booster, directs its firing energy at a main charge, which is arranged in the projectile body of the projectile, in order to transmit firing energy to fire the main charge.

In order to interrupt the firing chain it is known from U.S. Pat. No. 4,691,634 for an interrupter to be provided which moves one of the firing charges such that they are not arranged directly one behind the other when in the safe state, such that this charge cannot be struck and, in addition, cannot transmit firing energy any further. In order to arm the fuze, this firing charge is moved by the interrupter such that the charges are arranged directly one behind the other, thus allowing the firing charges to be fired successively.

SUMMARY OF THE INVENTION

It is an object of the invention to provide a fuze for a projectile which overcome the above-mentioned disadvantages of the heretofore-known devices and methods of this general type and which provides for a reliable fuze for a projectile, which can be designed to be particularly compact.

With the foregoing and other objects in view there is provided, in accordance with the invention, a fuze for a projectile having a firing chain, comprising:

- an interrupter disposed for interruption of the firing chain;
- the interrupter being configured to snap from a safe position to an armed position upon being unlocked; and
- a locking device for locking the interrupter in the safe position and for unlocking the interrupter by an unlocking movement, the unlocking movement being an axial movement of said locking device.

In other words, the objects of the invention are achieved with an interrupter for interruption of the firing chain that is designed to snap from a safe position to an armed position when unlocked, and with a locking device, or locking means, for locking the interrupter in a safe position and for unlocking the interrupter by an unlocking movement which, in accordance with the invention, is an axial movement.

That is, the invention proposes that the unlocking movement of the locking device be an axial movement. An "axial movement" in this context is a movement that has a vector component in the axial direction. The axial direction is the intended flight direction of the projectile, which is also defined by the longitudinal axis of the device. The use of the axial direction for the unlocking movement allows the fuze to be designed to be very compact in the radial direction, and is therefore suitable for small-caliber projectiles. In particular, the axial movement is directed only in the axial direction, with respect to the interrupter.

The interrupter advantageously supports a firing charge which, when the firing chain is interrupted, that is to say in the safe position, is sufficiently far away from a following firing charge that relaying is impossible, that is, safely prevented. The snap-action of the interrupter to its armed position results in the interrupter moving digitally from its safe position to its armed position, such that transitions are avoided by the very rapid movement of the interrupter. This digital behavior of the interrupter and its position resulting from this either in the safe position or in the armed position, but not in an intermediate position, make it possible to achieve a high safety level. Furthermore, the fuze can be used both for fast and for slow projectiles, without special settings. The snap-action may be an unrestrained movement, which is braked to a minor extent only by friction losses.

In the armed position, the locking device expediently engages in a closed cutout in the interrupter, for example a hole through the interrupter, and in particular does not project beyond the interrupter in the radial direction. The locking means can therefore be considered to be mounted in the interrupter. A bolt which engages in a recess in the interrupter is particularly suitable. The interrupter is advantageously a rotor. The movement of the rotor from the safe position to the armed position is a rotary movement about a rotation axis.

The fuze is advantageously designed such that, before carrying out the unlocking movement, the interrupter first of all must be unlocked, controlled by the projectile firing process, before the unlocking movement can be carried out. For this purpose, the fuze advantageously has a means for unlocking the interrupter, controlled by the projectile firing process, in addition to the locking means for further unlocking. A double-bolt system is particularly suitable for unlocking controlled by the projectile firing process. During the unlocking process controlled by the projectile firing process, the interrupter, and in particular also the locking means, advantageously remains in a position which is unchanged axially with respect to a fuze housing. This allows a separation between firing charges to be kept short, thus making it easier to use insensitive firing explosive.

In order to reliably reach a safe arming distance, an escapement mechanism is advantageous in order to delay the unlocking movement of the locking means after the unlocking process controlled by the projectile firing process. The escapement mechanism may be designed in the form of a clock mechanism with an armature, and may have an element which can be moved from a locking position to a released position, in which the interrupter is released, or can be released by one or more further arming measures. This element is expediently a segment, in particular a tooth segment. A radial physical space can be kept small if the segment is arranged at least partially on or under the interrupter in the axial direction. On and under should be understood in the sense of above and below, with above being the nose of the projectile.

The axial physical space of the fuze can be kept compact if the locking means is mounted in the interrupter and, in particular, when in the safe position, engages in a recess in a component which is fixed to the housing, and, in the armed position, is moved out of the recess. The component which is fixed to the housing may be a cover or cover panel, and is expediently mounted such that it cannot move with respect to a housing of the fuze. The locking means is advantageously mounted in the interrupter both in the safe position and in the armed position, thus making it possible to keep the space required for the locking means small. The locking means expediently also carries out the snap-action movement.

In accordance with an added feature of the invention, the snap-action movement is be spring-powered. The snap action movement can be carried out with a particularly high safety level if it is powered by centrifugal force. The required centrifugal force can be produced by the projectile spinning during flight.

A particularly efficient unlocking procedure for the interrupter can be carried out if the locking means is held in its locking position by an escapement mechanism, expediently by a segment. The escapement mechanism can thus release the locking means as it unwinds, thus unlocking the rotor. In the unlocked state, the locking means is advantageously inserted into a recess in an escapement mechanism, in particular into a recess in a segment of the escapement mechanism. If the recess has a ramp, then the locking means can slide from its locking position to its released position. The locking means expediently slides into the recess. The ramp allows the locking means to be moved out of the recess, thus making it possible to achieve a high freedom of movement for the locking means and the interrupter.

In a further advantageous embodiment of the invention, an element, in particular a segment, of an escapement mechanism is designed to also carry out at least a part of the snap-action movement to the armed position with the interrupter. This makes it possible to ensure that the elements which carry out the snap-action movement have a high mass, which is useful for high reliability when carrying out the snap-action movement, particularly when this is a snap-action movement powered by centrifugal force. The joint snap-action movement of the interrupter can be coupled to the segment by the locking means. The joint movement expediently comprises the start of the snap-action movement, such that the segment can pull the interrupter out of a slightly blocked position, if the interrupter is jammed, as is possible after long storage. If the final part of the snap-action movement is carried out by the interrupter on its own and without the segment, the interrupter can carry out a long movement without having to move the segment as well, thus making it possible to achieve a compact movement procedure.

In a further advantageous embodiment of the invention, the fuze comprises a double-bolt system for arming when the projectile is fired. The projectile firing acceleration can be used as an arming force, without the interrupter carrying out an axial movement. Axial physical spaces can therefore be made particularly small and the firing charges in the firing chain can be fitted very close to one another, thus making it considerably easier to use insensitive explosive.

Furthermore, the fuze expediently comprises an opposing rotary spring in order to pull the interrupter in the direction of its safe position. This counteracts inadvertent movement of the interrupter from its safe position to its armed position, for example if the locking means is defective.

The interrupter is expediently locked in its armed position by the opposing rotary spring. This makes it possible to reduce the risk of an unexploded projectile. The double function of the opposing rotary spring makes it possible to save a further component, and to reduce the physical space.

A spiral spring is particularly suitable for use as the opposing rotary spring for a rotor. This can be integrated in a compact form in the fuze. The opposing rotary spring is expediently wound around a rotation axis of the interrupter, thus making it possible to design the fuze to be simple. For locking, the rotary spring advantageously engages in an element which is fixed to the housing. It is also good for compactness for the opposing rotary spring to be mounted completely within the interrupter, except for an engagement element for locking engagement.

Other features which are considered as characteristic for the invention are set forth in the appended claims.

Although the invention is illustrated and described herein as embodied in a fuze for a projectile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings. While the drawing illustrates one exemplary embodiment of the invention, the drawing and the description contain numerous features in combination, which those of skill in the pertinent art will expediently also consider individually and combine them to make further worthwhile combinations.

BRIEF DESCRIPTION OF THE SEVERAL VIEWS OF THE DRAWING

FIG. 3 is a plan view of the fuze in an intermediate position;

FIG. 4 is a section through the fuze, taken along the line IV-IV in FIG. 3.

DETAILED DESCRIPTION OF THE INVENTION

Figure 1:
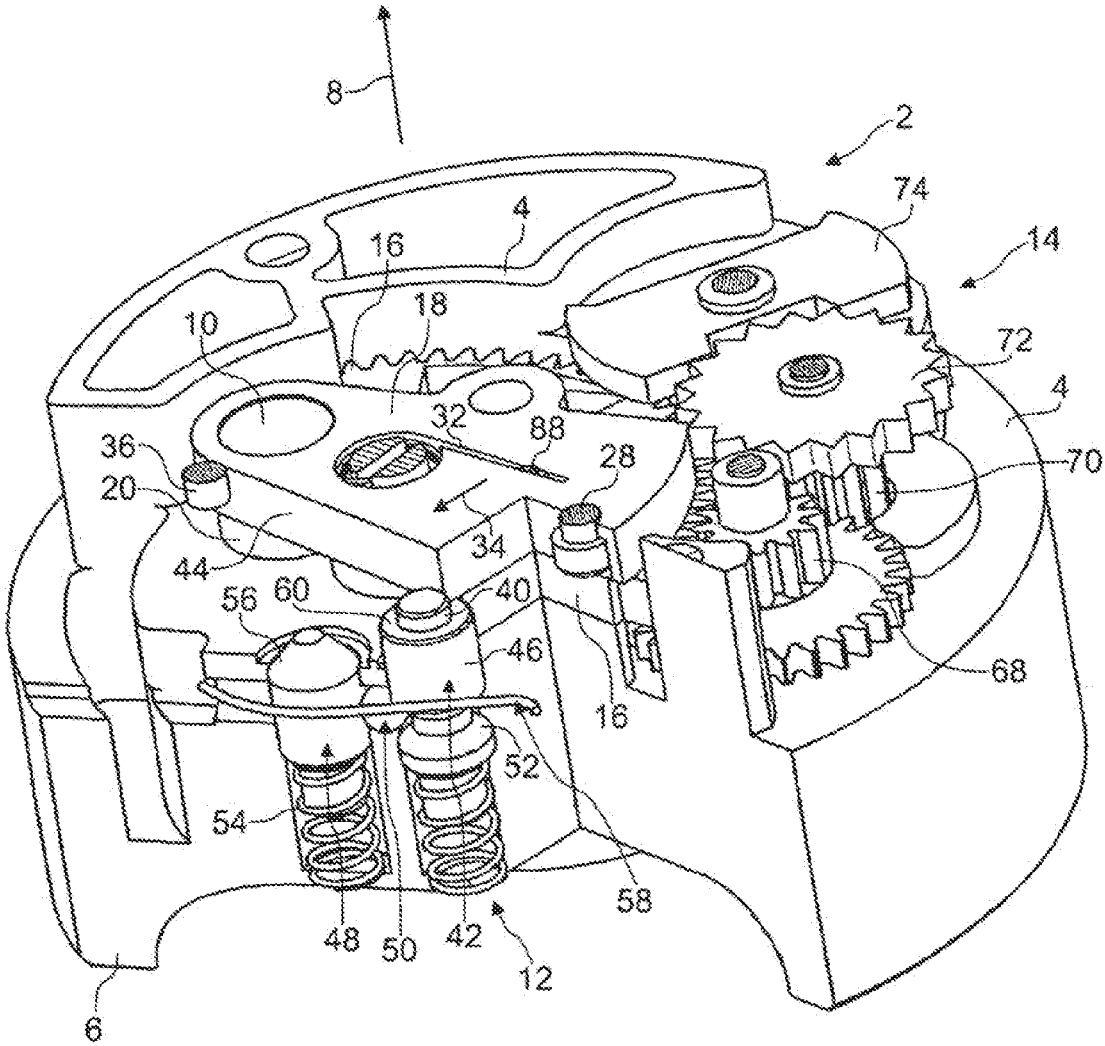
FIG. 1 is a partially broken, perspective view of a detail of a fuze of a projectile in the safe position.

Referring now to the figures of the drawing in detail and first, particularly, to FIG. 1 thereof, there is shown a partially sectioned perspective illustration of a part of a fuze 2 with a housing 4 which is intended to be attached in its lower area 6 to a body of a projectile. A part of the fuze 2 which is at the front in a direction of flight 8 of the projectile, or is the upper part in the view shown in the figures, has been omitted, in order to illustrate the elements shown in FIG. 1 better and comprises an upper part of the housing 4, an impact firing mechanism with a fuze needle for piercing a detonator 10, and further elements.

The fuze 2 is provided with a double-bolt system 12 and with an escapement mechanism 14, which is designed like a clock mechanism, with a toothed segment 16 and an interrupter 18, which is arranged on the segment 16 and in which the detonator 10 is mounted. The interrupter 18 and the segment 16 are illustrated in partially sectioned form in FIG. 1. The detonator 10 is a part of a firing chain having at least two firing charges, specifically the detonator 10 and a booster, which is not illustrated but is arranged underneath the segment 16 on the center axis of the projectile or of the fuze 2.

FIG. 1 shows the fuze 2 in its safe position. In this position, the detonator 10 is arranged separately from the booster and sufficiently far away from it that relaying to the subsequent booster is reliably prevented in the event of inadvertent detonation of the detonator 10. An opening above the booster is covered by the segment 16, and blocks a direct connection between the detonator 10 and the booster. In addition, the segment 16 blocks any movement of the interrupter 18 directly to its armed position, since an element of the interrupter 18, specifically a depression 20 for holding the detonator 10, would strike against an edge 22 (see FIG. 5) of the segment 16 if the interrupter 18 were to move to its armed position, thus blocking further movement of the interrupter 18 to the center.

Figure 2:
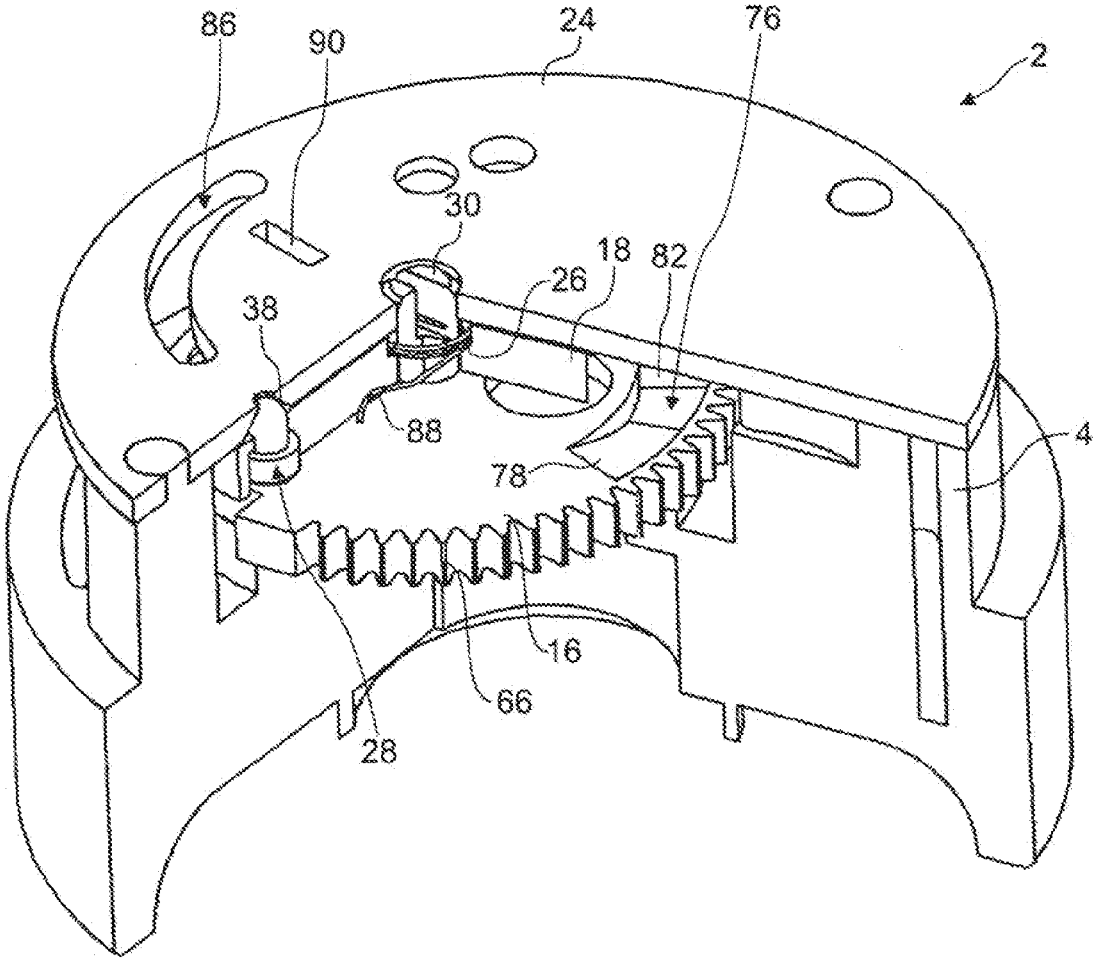
FIG. 2 is a further partially sectioned perspective view of the detail of the fuze, with a cover fitted.

FIG. 2 shows a different, partially sectioned detail view of the fuze 2 with a cover panel 24 which is fixed to the housing fitted, likewise in the safe position. The interrupter 18 is shown in a sectioned form, thus providing a free view of an opposing rotary spring 26 and a locking means 28, or locking device 28, within the interrupter 18. The opposing rotary spring 26 is a torsion spring in the form of a spring clip, one of whose limbs is held fixed to the housing in a gap in a shaft 30 about which the interrupter 18 is mounted such that it can rotate. The other limb is held in a slot 32, as illustrated in FIG. 1, in the interrupter 18, which is in the form of a rotor, and is prestressed torsionally, such that this limb loads the interrupter 18 with a counter-clockwise force, and in the opposite direction to the arming direction 34. The rotor or interrupter 18 is thus pulled by the opposing rotary spring 26 in the direction of its safe position and is pushed against a stop 36, which predetermines the safe position.

In addition, the interrupter 18 is held in its safe position by the double-bolt system 12 and the locking device or locking means 28, which is in the form of a bolt. The locking means 28 engages in a conical recess 38 in the cover panel 24 which is fixed to the housing, and is held all round by the interrupter 18, and is therefore mounted in it, such that the locking means 28 is fixed firmly in the interrupter 18 in the radial direction and tangential direction. In the axial direction, that is to say parallel to the direction of flight 8 but downward, the locking means 28 is blocked by the segment 16 of the escapement mechanism 14, thus blocking a downward unlocking movement. The locking means 28 locks the interrupter 18 in its safe position by means of this blocking and the engagement in the recess 38 which is fixed to the housing, as well as the mounting in the interrupter 18.

Before the projectile is fired, the components of the fuze 2 are as illustrated in FIGS. 1 and 2. In addition to the locking means 28 and the opposing rotary spring 26, the interrupter 18 is blocked in its safe position by stop 40 on a bolt 42 of the double-bolt system 12, on which one side 44 of the interrupter 18 rests. A further stop 46 on the bolt 42 blocks the segment 16 analogously in its locking position.

When the projectile is fired, powerful acceleration forces act in the direction of flight 8 on all the components of the fuze 2. Because of their inertia, all the components are forced downward relative to the housing 4, and in the opposite direction to the direction of flight 8. Therefore, also the two bolts 42, 48 of the double-bolt system 12, with the bolt 42 being mounted fixed to the housing by means of a ball 50 which engages in a recess 52 in the bolt 42, and in the axial direction, that is to say parallel to the center axis 62, which is illustrated in FIG. 3, of the fuze 2 and of the projectile. However, the bolt 48 can move freely axially and, driven by its inertia, compresses a spiral spring 54 downward on its way, which spiral spring 54 holds it at the top in its safe position when there is no acceleration on the fuze 2.

During the downward movement of the bolt 48, the bolt 42 is also forced downward and an incline, which is not illustrated, at the end of the recess 52 in it presses against the ball 50 and into this in the tangential direction against the bolt 48, which blocks tangential movement of the ball 50. However, as soon as the bolt 48 has been forced sufficiently far downward that a chamfer 56 comes into the area of the ball 50, the ball 50 can escape in the tangential direction, and is forced out of the recess 52 by the chamfer on the bolt 42. As soon as the ball 50 has emerged completely out of the recess 52, the bolt 42 is also forced downward and its side 46 blocks the ball 50 in the area of the chamfer 56, as a result of which the bolt 48 is blocked in its lower arming position and cannot be driven upward again by the spiral spring 54. As a result of the release movement of the bolt 42, this first of all allows the interrupter 18 to carry out an arming movement which, however, is blocked again by the locking means and, as the process continues, also a release movement of the segment 16. As soon as the bolt 42 has been forced sufficiently far downward, a latching spring 58 springs into a recess 60, which forms the stop 40, in the bolt 42, and locks this in its lower unlocking position. The unlocking movement of the double-bolt system 12 therefore unlocks the segment 16, while the interrupter 18 is still locked by the locking means 28.

As the projectile is fired, a spinning movement is impressed on the projectile, in the form of a rapid rotation about its centre axis 62. This results in a powerful centrifugal force being exerted radially outward on all the elements of the fuze 2. As can be seen from FIG. 2 and FIG. 3, both the segment 16 and the interrupter 18 are mounted such that they can rotate about a rotation axis 64 within the shaft 30. These figures also show that the center of gravity of the segment 16 is not located on this rotation axis 64 but well away from it, as a result of which the segment 16 is forced radially outward by the centrifugal force, and is thus forced to carry out a rotary movement in the clockwise direction about the rotation axis 64. The tooth system 66 on the segment 16 exerts a force on gearwheels 68, 70 of the escapement mechanism 14, which in turn act on an armature wheel 72 and an armature 74 of the escapement mechanism 14. The armature 74 is moved in a reciprocating manner, analogously to a clock mechanism, and allows the armature wheel 72 to rotate in steps. This rotary movement is transmitted, stepped down, to the segment 16, which rotates about the rotation axis 64 in the clockwise direction, or arming direction 34.

Figure 5:
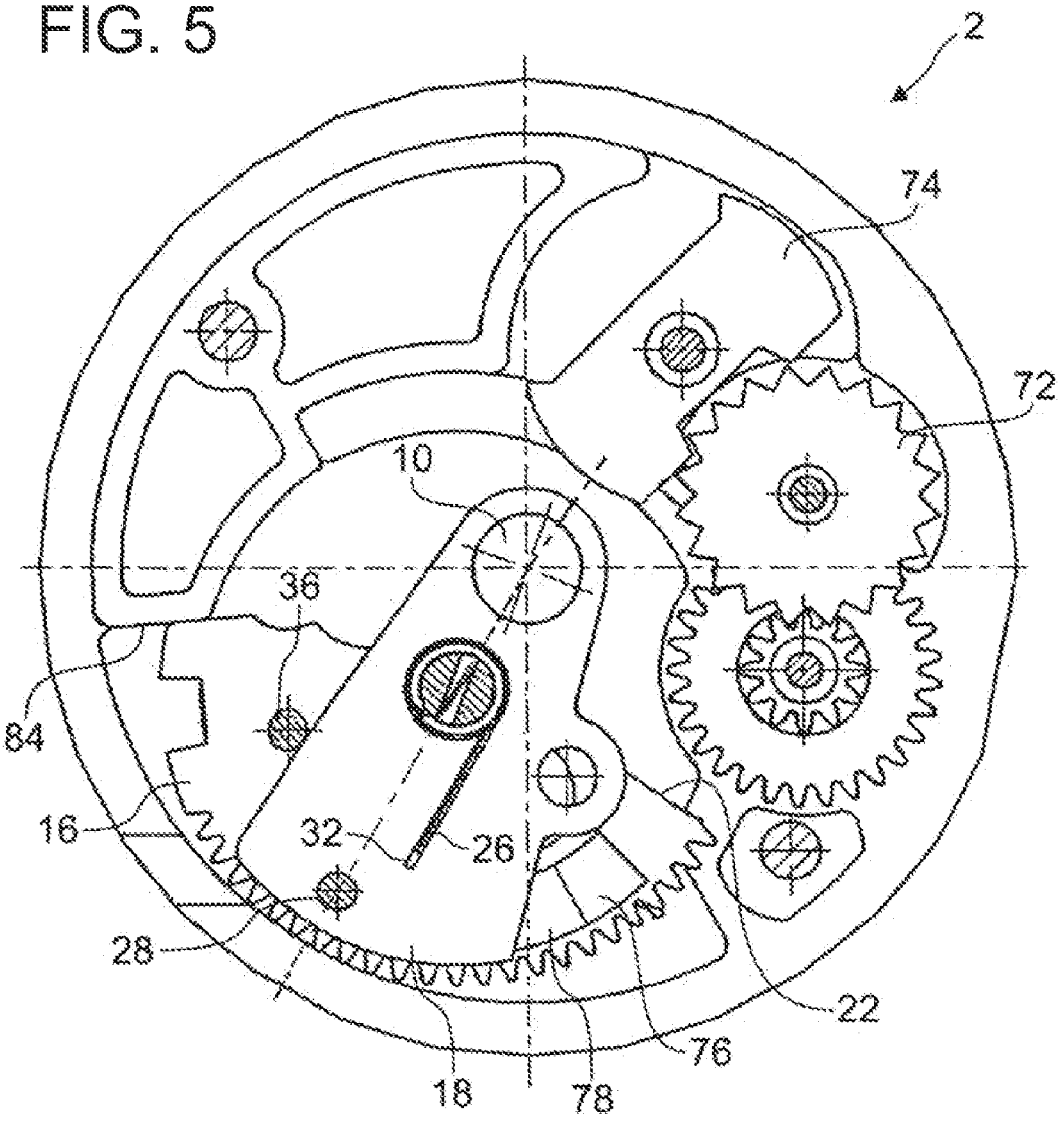
FIG. 5 is a plan view of the fuze in its armed position.

FIG. 3 shows an intermediate position of the segment 16 between its locking position, as illustrated in FIG. 1, and its released position, as illustrated in FIG. 5. This intermediate position is illustrated in a partially sectioned form in FIG. 4. The rotary movement of the segment 16 moves a recess 76 toward the locking means 28 as far as a position as illustrated in FIG. 4. The locking means 28 is designed to be rounded at the bottom, that is to say toward the segment 16, advantageously in the form of a ball cup, with this rounded shape sliding into the recess 76 as a result of further movement of the segment 16 on a ramp 78. The movement of the locking means 28 in the axial direction is produced by the centrifugal force of the interrupter 18 in conjunction with the inclined surface of the conical recess 38, since the center of gravity of the interrupter 18 is also not located on the rotation axis 64, and the interrupter 18 is forced in the arming direction 34 by the centrifugal force. The locking means 28 is thus forced against the incline on the conical recess 38, which forces it downward into the recess 76. This unlocking movement, which takes place downward in the axial direction 80 relative to the interrupter 18 and is subject to additional lateral components relative to the housing 4 because of the lateral migration within the recess 38, results in the interrupter 18 being unlocked as soon as the locking means 28 has emerged completely out of the recess 38.

However, the interrupter 18 cannot snap immediately to an armed position on its own even in its state in which it has been unlocked by the locking means, because the interrupter 18 and the segment 16 are coupled by the locking means 28 during their further movement. The interrupter 18 and the segment 16 have to move relative to one another such that the locking means 28 remains within the recess 76, since the cover panel 24 prevents it from moving upward and out of the segment 16. As can be seen in FIG. 3, the tooth system 66 ends up approximately coincidently with the position in which the locking means 28 has emerged completely out of the recess 38. This also ends the constriction of the release movement of the segment 16 by the escapement mechanism 14, and this can snap essentially freely to its released position, driven by centrifugal forces, as is illustrated in FIG. 5. This snap-action movement can also be carried out by the interrupter 18, as a result of which the segment 16 and the interrupter 18 synchronously move through the first part of the snap-action movement of the interrupter 18. In the situation in which the interrupter 18 is not moved out of its safe position for any inadvertent reason, for example because a critical element has corroded such that it is fixed, then a stop surface 82 on the recess 76 strikes against the locking means 28 and thus forces the interrupter 18 out of its safe position. The interrupter 18 is released from, for example, the seized position, and itself starts to carry out its arming movement in the direction of the armed position. This results in a high degree of reliability against unexploded projectiles.

Once the segment 16 has reached its released position, and has partially accommodated the locking means 28, the segment 26 and the interrupter 18 and, with it, the locking means 28, carry out the first part of the snap-action movement of the interrupter together, until the segment 16 strikes against a surface 84 of the housing 4. The segment 16 has reached its final position while, in contrast, the interrupter 18 continues to carry out its snap-action movement. The locking means 28 is in this way guided onto the ramp 78 again, and is pulled out of the recess 76, with the locking means 28 entering a recess 86 (see FIG. 2) in the cover panel 24. The recess 86 makes it possible to decouple the movement of the interrupter 18 from the movement of the segment 16. The interrupter 18 carries out its snap-action movement essentially without impediment, as far as the armed position illustrated in FIG. 5.

On reaching this armed position, the interrupter 18 strikes against the stop 36, which therefore predetermines the armed position. The stop 36 is a depression in the cover panel 24, and is therefore fixed to the housing. In this position, a tab 88 (see FIGS. 1 and 2) on the opposing rotary spring 26 latches into a recess 90 in the cover panel 24, and thus locks the interrupter 18 in its armed position. The detonator 10 is now on the center axis 62 of the projectile and is arranged in line with the booster, which is located underneath it, thus allowing relaying to take place from the detonator 10 to the booster. The interrupter 18 or rotor, and therefore the fuze 2, are in their armed position.

The invention claimed is:

1. A fuze for a projectile having a firing chain, comprising:
an interrupter disposed for interruption of the firing chain;
said interrupter being configured to snap from a safe position to an armed position upon being unlocked;
a locking device for locking said interrupter in the safe position and for unlocking said interrupter by an unlocking movement, the unlocking movement being an axial movement of said locking device; and
an escapement mechanism holding said locking device in the locking position, said escapement mechanism carrying out a rotary movement for unlocking said locking device.

2. The fuze according to claim 1, which further comprises an escapement mechanism having a segment with a locking position and a released position, wherein said segment is arranged at least partially on or below said interrupter in the axial direction.

3. The fuze according to claim 1, which comprises a housing-stationary component formed with a recess, and wherein said locking device is mounted in said interrupter and, in the safe position, said locking device engages in said recess and, in the armed position, said locking device is moved out of said recess.

4. The fuze according to claim 1, wherein said locking device is mounted in said interrupter, both in the safe position and in the armed position.

5. The fuze according to claim 1, which comprises an escapement mechanism formed with a recess, and wherein said locking device, in an unlocked state, is inserted into said recess in said escapement mechanism.

6. The fuze according to claim 1, which comprises an escapement mechanism formed with a segment disposed to also carry out at least a portion of the snap-action movement to the armed position together with said interrupter.

7. The fuze according to claim 6, wherein the part of the snap-action movement comprises a start of the snap-action movement.

8. The fuze according to claim 6, which said locking device is disposed to couple the joint snap-action movement of said interrupter with said segment of said escapement mechanism.

9. The fuze according to claim 6, wherein a final portion of the snap-action movement is carried out by said interrupter on its own, without said segment of said escapement mechanism.

10. The fuze according to claim 1, which comprises a double-bolt system for arming when the projectile is fired, said double-bolt system locking said interrupter and an element of an escapement mechanism in the safe position.

11. A fuze for a projectile having a firing chain, comprising:
an interrupter disposed for interruption of the firing chain;
said interrupter being configured to snap from a safe position to an armed position upon being unlocked;
a locking device for locking said interrupter in the safe position and for unlocking said interrupter by an unlocking movement, the unlocking movement being an axial movement of said locking device; and
a ramp on which said locking device slides from the locking position to the released position thereof.

12. The fuze according to claim 11, which comprises an escapement mechanism having said ramp formed therein.

13. The fuze according to claim 11, wherein, in the armed position, said locking device is moved out of a recess by way of said ramp.

14. A fuze for a projectile having a firing chain, comprising:
an interrupter disposed for interruption of the firing chain;
said interrupter being configured to snap from a safe position to an armed position upon being unlocked;
a locking device for locking said interrupter in the safe position and for unlocking said interrupter by an unlocking movement, the unlocking movement being an axial movement of said locking device; and
an opposing rotary spring locking said interrupter in the armed position thereof, said rotary spring having an acting force pulling said interrupter in a direction of the safe position thereof.

* * * * *